US007434532B2

(12) United States Patent
Kaneko

(10) Patent No.: US 7,434,532 B2
(45) Date of Patent: Oct. 14, 2008

(54) FLUID FILLER OPENING SYSTEM FOR A SMALL PLANING BOAT

(75) Inventor: Yoshiyuki Kaneko, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/693,581

(22) Filed: Mar. 29, 2007

(65) Prior Publication Data

US 2007/0227427 A1 Oct. 4, 2007

(30) Foreign Application Priority Data

Mar. 31, 2006 (JP) ..... 2006-096721

(51) Int. Cl.
*B63B 17/00* (2006.01)

(52) U.S. Cl. ..... 114/343; 114/55.53

(58) Field of Classification Search ..... 114/343, 114/55.53
See application file for complete search history.

(56) References Cited

U.S. PATENT DOCUMENTS 5,865,222 A * 2/1999 Diamond ..... 141/86
2003/0129890 A1* 7/2003 Nagata et al. ..... 440/88 F
2004/0110432 A1* 6/2004 Ozawa ..... 440/87

FOREIGN PATENT DOCUMENTS

JP 2000-053091 2/2000

* cited by examiner

*Primary Examiner*—Stephen Avila
(74) *Attorney, Agent, or Firm*—Knobbe Martens Olson & Bear LLP

(57) ABSTRACT

A small planning boat includes a filler opening for a fuel tank and an opening section that are formed on the deck of the boat body. The filler opening and the opening section are covered with a hatch cover when the hatch cover is closed. A fuel-receiving concave section is formed around the filler opening, so that the filler opening is positioned at the bottom surface section of a fuel-receiving concave section. A guide groove that declines downward from the bottom surface section on an outer side of the boat body can be formed as one piece with the fuel-receiving concave section. A storage section can also be formed inside the opening section. In addition, the filler opening can be positioned on the starboard side rearward from the opening section, and the guide groove can be formed in a section on an outer side of the opening section.

22 Claims, 10 Drawing Sheets

FLUID FILLER OPENING SYSTEM FOR A SMALL PLANING BOAT

PRIORITY INFORMATION

The present application is based on and claims priority under 35 U.S.C. §119 to Japanese Patent Application Serial No. 2006-096721, filed on Mar. 31, 2006, the entire contents of which are expressly incorporated by reference herein.

BACKGROUND OF THE INVENTION

1. Field of the Invention

The present invention relates to a small planing boat of which a filler opening can be covered with a hatch cover.

2. Description of the Related Art

Many small planing boats are propelled by taking in water, such as sea water, from a bottom of the boat by using a jet pump and by jetting the water out behind the stern to plane on the water. An example of such small planing boats is described in Japanese Publication No. P-A-2000-53091, which describes covering a filler opening used for filling an oil tank with a hatch cover to make the opening section invisible from the outside when the hatch cover is closed.

However, in some conventional planing boats, because the filler opening can be in a relatively higher position on the deck of the boat, fuel or other fluid that may be spilled can remain on a part of the deck. For example, when the floor has concave sections on both sides of a seat on the deck, if fuel is spilled out from a filler opening during filling, it is possible that spilled fuel may flow onto the floor and stay there. When the small planing boat is being filled while on the water or at another outside location, fuel being filled can often be spilled out while the small planing boat rocks, especially due to a wave or a strong wind. In a case like this, fuel may remain on the floor or on another part of the boat deck.

SUMMARY OF THE INVENTION

An aspect of the present invention is the recognition of the need for a small planing boat which does not allow fuel or other fluid that is spilled out of a filler opening to stay on a deck floor or in any other part of a boat body.

In one embodiment, the present invention involves a filler opening system for a small planing boat that comprises a boat body having a deck with a front side section. An upper surface of the front side section has an opening section. A filler opening is provided in the vicinity of the opening section. The opening section is closed and opened with a hatch cover, and the filler opening is adapted to be covered by closing the opening section with the hatch cover. The filler opening is in communication with a fuel tank disposed within the boat body. A fuel-receiving concave section can be formed around the filler opening in the upper surface of the deck. The filler opening can be positioned in a bottom portion of the fuel-receiving concave section, and a guide groove can be formed to decline downward from the bottom of the fuel-receiving concave section.

In another embodiment of the present invention, the filler opening is configured to be covered with the hatch cover. The filler opening can thereby be invisible from outside, and the design of the small planing boat can be enhanced. The filler opening can be placed at the bottom section of the fuel-receiving concave section formed on the upper surface of the deck, and the guide groove extending from the bottom section of the fuel-receiving concave section downwardly and outwardly of the boat body. Therefore, because fuel flows into the fuel-receiving concave section at first, even if fuel is spilled out of the filler opening during filling, fuel does not spread around. Because fuel spilled out into the fuel-receiving concave section then flows downwardly with respect to the boat body via the groove guide, the spilled fuel does not stay in a certain part of the boat body, such as on a floor of the deck and does not flow inside of the opening section.

In another embodiment of the present invention, the fuel-receiving concave section can be defined by a bottom surface section and a partition wall. The bottom surface section is shaped as a generally flat surface and is disposed around the filler opening. The partition wall can be formed to partially surround the bottom surface section. The bottom surface section can be formed to decline toward a section connected with the guide groove. Since a section around the filler opening can be formed as a generally flat bottom surface section, it can be easy to handle a cap for opening and closing the filler opening. Since the section connected with the guide groove in the bottom surface section can be lower than other sections in the bottom surface section, when fuel is spilled out into the fuel-receiving concave section, spilled fuel does not stay in the fuel-receiving concave section but can be efficiently guided and can flow in a downward direction along the boat body via the guide groove.

In a further embodiment of the present invention, a storage section for storing an object can be provided in the opening section on the inner side of the boat body. One or more objects can be stored in the storage section, and the hatch cover can be used as a lid for opening and closing the storage section. The fuel-receiving concave section can prevent fuel spilled out of the filler opening from entering the storage section.

In another embodiment of the present invention, the filler opening is disposed near the rear of the opening section of the boat body and is deviated from a center of a transverse direction to either side thereof. The guide groove can be formed so as to extend outside of the side sections on left and/or right sides of the opening section in a plan view.

Generally, a storage space can be formed inside of an opening section formed in a front side section of a small planing boat. A section in the vicinity of the opening section inclines upward to a higher position as the section comes closer to a rear side of the boat body. Therefore, because a filler opening and a fuel-receiving concave section can be placed in a position rearward from the opening section and deviated from a center of a transverse direction to either direction (on a portside or starboard side) of the boat body, it is possible that the filler opening can be formed in a high position and that water resulted from a splash or the like can be prevented from entering the filler opening during filling.

Because the fuel-receiving concave section can be formed around the filler opening, spilled fuel can be prevented from entering a storage section via the opening section. In addition, because the guide groove can be formed not in a side section of the opening section but in an outside section of the boat body, fuel spilled out of the filler opening can be guided in a down direction on an outside of the boat body while a sufficient size of the opening section can be ensured.

In another embodiment of the present invention, the fuel-receiving concave section is formed with a concave forming member that can be separate from a member of the deck. Since the concave section forming member having the fuel-receiving concave section can be formed as a member separate from the deck, it is not necessary to form the fuel-receiving concave section by processing the deck. This can increase the ease with which the deck may be manufactured and the fuel-receiving concave section may be formed.

In a further embodiment of the present invention, the concave forming member is configured to include a guide groove forming section having the guide groove, and the concave forming member including the guide groove forming section being configured to be molded in one piece as a member separate from the deck. Since the fuel-receiving concave section and the guide groove can be formed in one piece as a concave section forming member, the number of parts can be smaller than that of a case where the fuel-receiving section and the guide groove are formed separately, and it is not necessary to assemble a concave section forming member only forming a fuel-receiving concave section and a guide groove forming section. The ease with which the fuel-receiving concave section and the guide groove may be formed is thus enhanced.

In another embodiment of the present invention, the concave section forming member is made from a resin material, which can make it possible to manufacture and process the concave section forming member in a simple manner and/or at a reduced cost.

In a further embodiment of the present invention, a hole is formed in a portion corresponding to a bottom section of the concave forming member such that the hole has a diameter larger than that of the filler opening. The filler opening can be exposed through the hole when the concave forming member is installed to the deck. A seal member can be interposed between a peripheral edge of the hole and the deck. This can make it easy to install the concave section forming member by placing the hole of the concave section forming member on the filler opening in order to install the concave section forming member to the deck. In addition, the seal member can prevent fuel from being spilled out from a gap between the deck and the concave section forming member.

An additional aspect of the present invention involves extending the guide groove from the fuel-receiving concave section toward a front side of the boat body. Accordingly, fuel spilled out of the filler opening can be prevented from flowing to a floor side of the deck.

BRIEF DESCRIPTION OF THE DRAWINGS

These and other features, aspects and advantages of the present invention are described in detail below with reference to the drawings of preferred embodiments, which embodiments are intended to illustrate and not to limit the present invention.

DETAILED DESCRIPTION OF PREFERRED EMBODIMENTS

The following description explains a small planing boat according to an embodiment of the present invention in detail with reference to accompanying drawings.

As used through this description, unless indicated otherwise or otherwise readily apparent from the use in context, the terms "forward," "front," and "frontward" refer to a direction that is towards a front of the small planing boat or to a portion (such as a portion of a component) that is nearer to the front of the small planing boat. The term "rear," unless indicated otherwise or otherwise readily apparent from the use in context, refers to a direction that is towards a rear of the small planing boat or to a portion (such as a portion of a component) that is nearer to the rear of the small planing boat. The terms "center" and "center side," unless indicated otherwise or otherwise readily apparent from the use in context, refer to a direction that is towards an imaginary line that runs lengthwise along a center portion of the small planing boat or to a portion (such as a portion of a component) that is nearer to the center line of the small planing boat. The terms "outward," "outwardly" and "outside," unless indicated otherwise or otherwise readily apparent from the use in context, refer to a direction that is away from the imaginary center line and towards the lateral edges of the small planing boat or to a portion (such as a portion of a component) that is farther from the center line of the small planing boat. The terms "high" and "higher" unless indicated otherwise or otherwise readily apparent from the use in context, refer to a direction that is elevated up away from the water level in which the small planing boat is floating, while the terms "down," "low" and "lower" refer to a direction that is towards the water level in which the small planing boat is floating.

Figure 1:
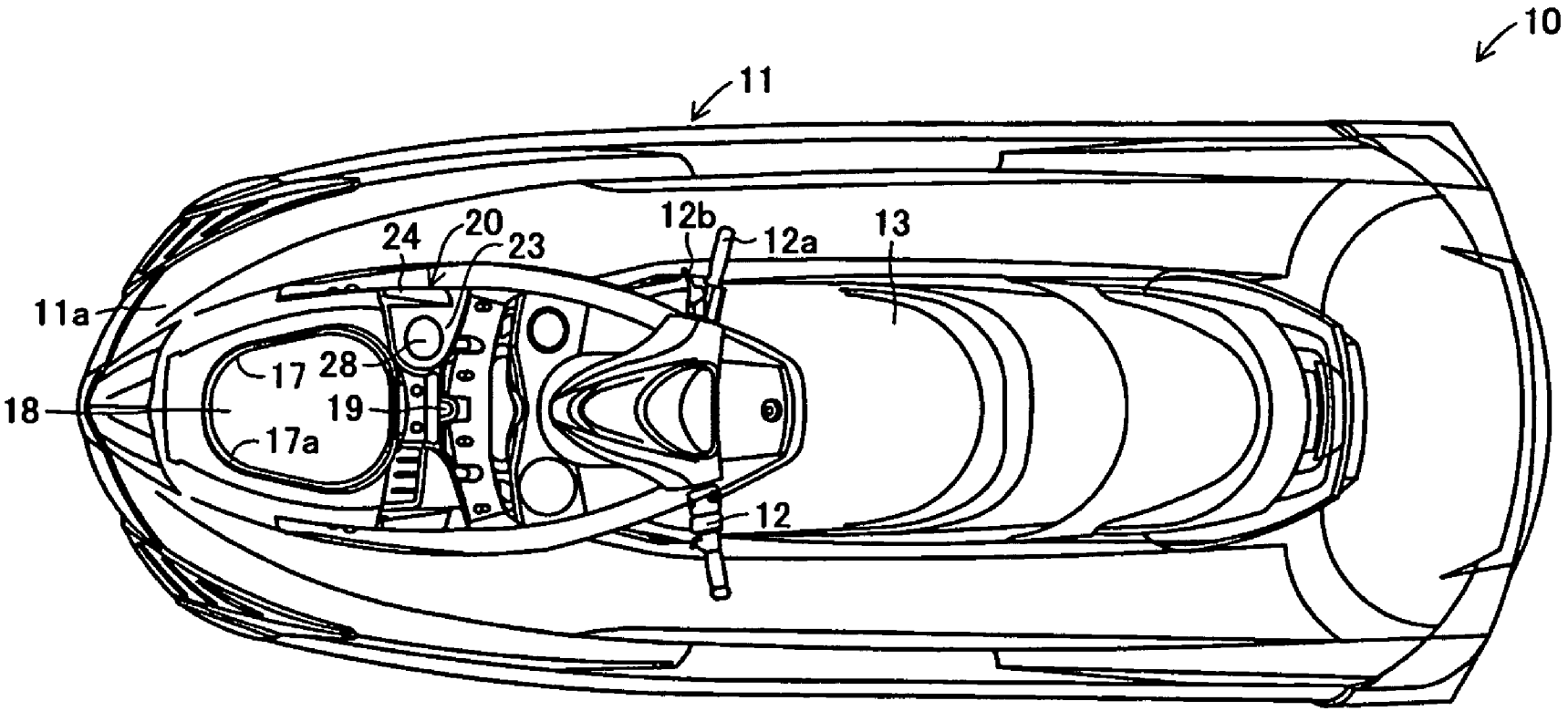
FIG. 1 shows a plan view illustrating a small planing boat according to an embodiment of the present invention.
Figure 2:
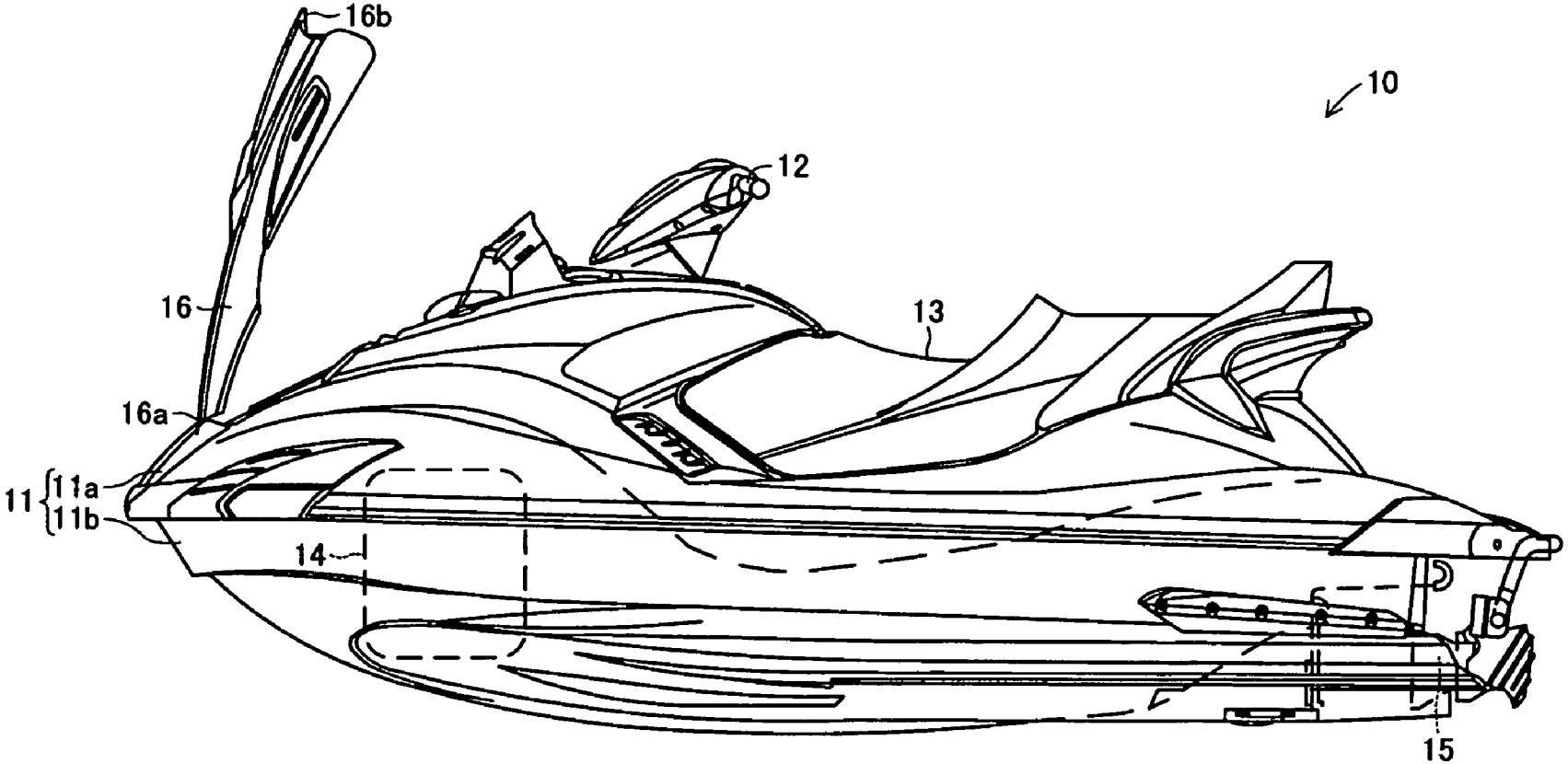
FIG. 2 shows a side view of the small planing boat depicted in FIG. 1, illustrating a state in which a hatch cover of the small planing boat is opened.

FIG. 1 and FIG. 2 show a small planing boat 10 according to an embodiment of the present invention. The small planing boat 10 has a boat body 11 formed with a deck 11*a* and a boat body 11*b* that are assembled to one another. Steering handle bars 12 can be installed to a section slightly frontward of a center section on an upper section of the boat body 11. A seat 13 can be installed to the center section on the upper section of the boat body 11. In the boat body 11, there can be an engine room (not shown) formed from a front section to a center section in the boat body 11 and a pump room (not shown) formed in a rear section in the boat body 11. In the engine room, a fuel tank 14, an engine, an intake apparatus, an exhaust apparatus, and so forth can be installed. In the pump room, a propulsion unit 15 formed with a jet pump and so forth can be installed.

Figure 3:
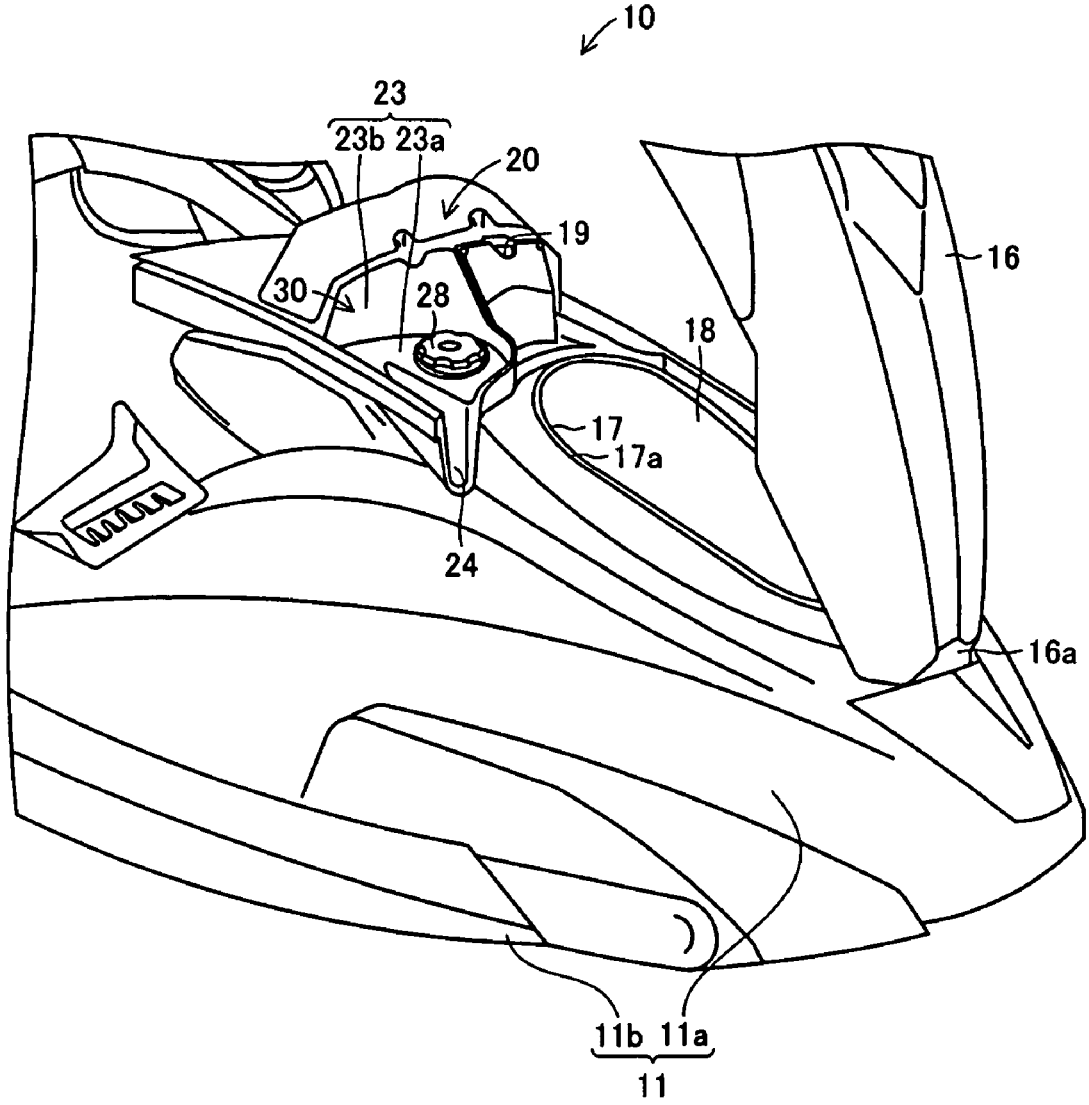
FIG. 3 shows an oblique view of a portion of the small planing boat depicted in FIG. 1, illustrating an opening section of the small planing boat.

As shown in FIG. 2 and FIG. 3, a hatch cover 16 can be installed in a front side section on the upper surface of the deck 11*a* so as to be pivotable up and down about a front-end section 16*a* of the hatch cover 16. FIG. 1 shows the small planing boat 10 with the hatch cover 16 removed. As will be apparent to one of ordinary skill in the art in view of the present disclosure, in other embodiments, other known methods of opening and closing the hatch cover 16 may be used.

In the front side section on the upper surface of the deck 11*a*, an opening section 17 can be formed, and the hatch cover 16 can be formed to open and close the opening section 17. Inside the opening section 17, a storage section 18 for storing objects can be formed.

In a peripheral section of the opening section 17, a seal section 17*a* can be formed, and a gap between the peripheral section of the opening section 17 and a bottom surface of the hatch cover 16 can sealed by a waterproof seal section 17*a*. The front side section on the upper surface of the deck 11*a* can be shaped into a convex form from a front section to a rear section. The hatch cover 16 can be shaped to form a curve in a rear section of the hatch cover 16 to conform to the shape of the front section on the upper surface of the deck 11*a*.

Figure 4:
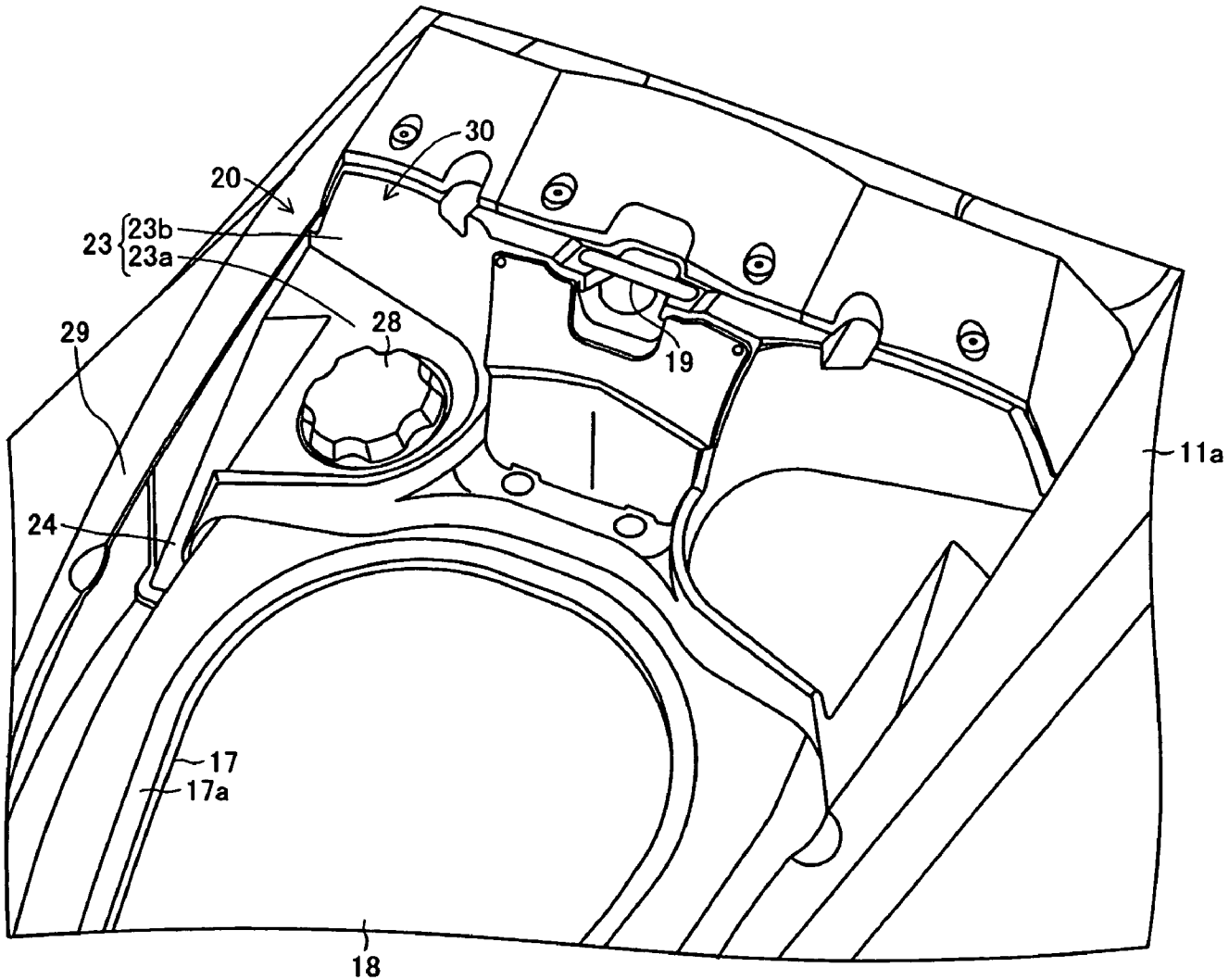
FIG. 4 shows an oblique view of a portion of the small planing boat depicted in FIG. 1, illustrating a portion in the vicinity of a lock mechanism.
Figure 5:
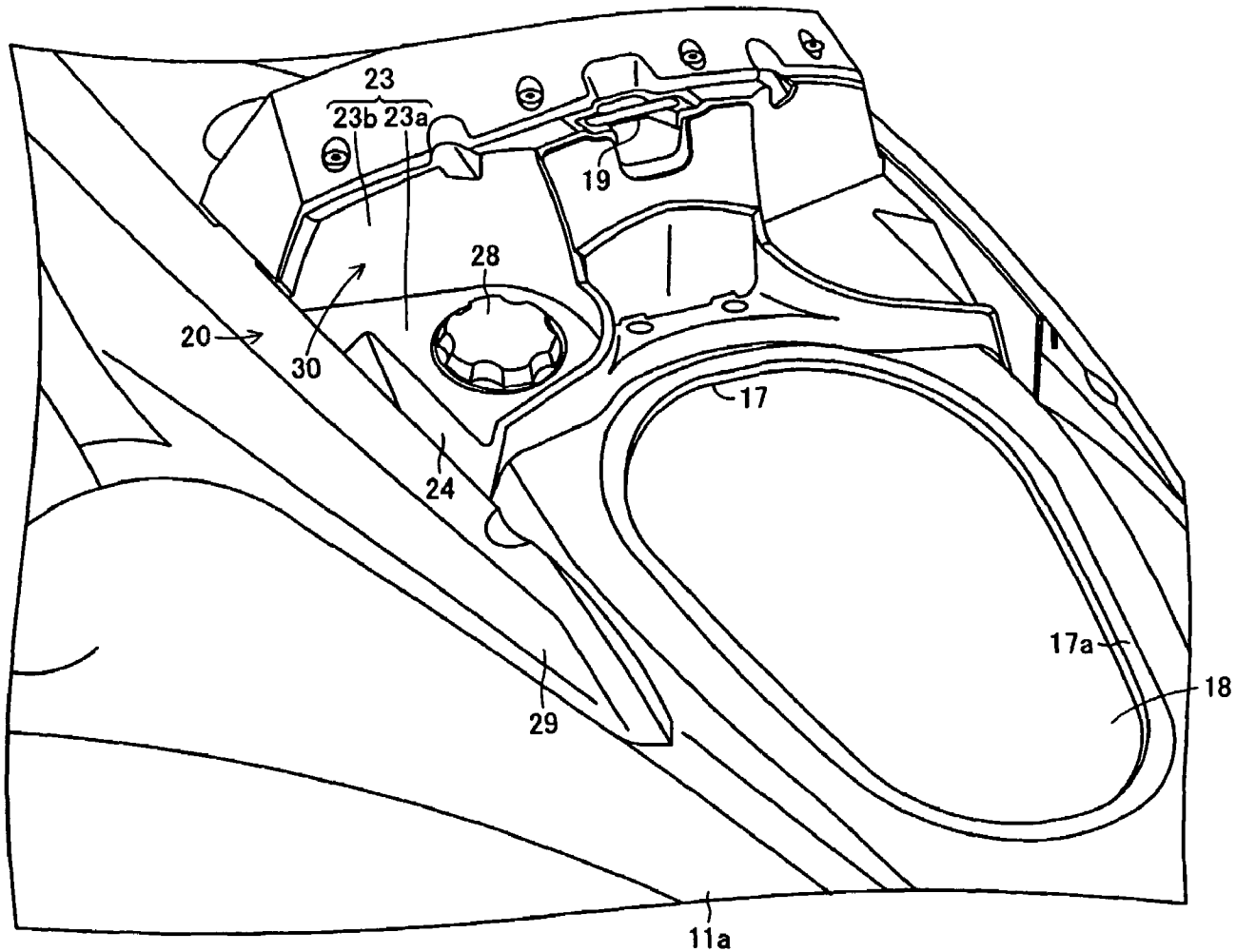
FIG. 5 shows another oblique view of a portion of the small planing boat depicted in FIG. 1, illustrating the vicinity of the lock mechanism and the opening.

In a section on the upper surface of the deck 11*a* that corresponds to a rear end section 16*b* of the hatch cover 16, an engaged section 19 for a lock mechanism can be formed. FIGS. 3-5 illustrate the engaged section 19 for a lock mechanism. An engaging section (not shown) which can engage with the engaged section 19 can be formed below the rear end section 16*b* of the hatch cover 16. By engaging the engaging section with the engaged section 19, the opening section 17 can be kept closed by the hatch cover 16. By disengaging the engaging section and the engaged section 19, the hatch cover 16 can be opened. In one embodiment, a mechanism for releasing the lock mechanism can be formed in the vicinity of the handlebars 12. In one embodiment, the engaging section and the engaged section 19 can be engaged by pressing the hatch cover 16 onto the upper surface of the deck 11*a*.

Figure 6:
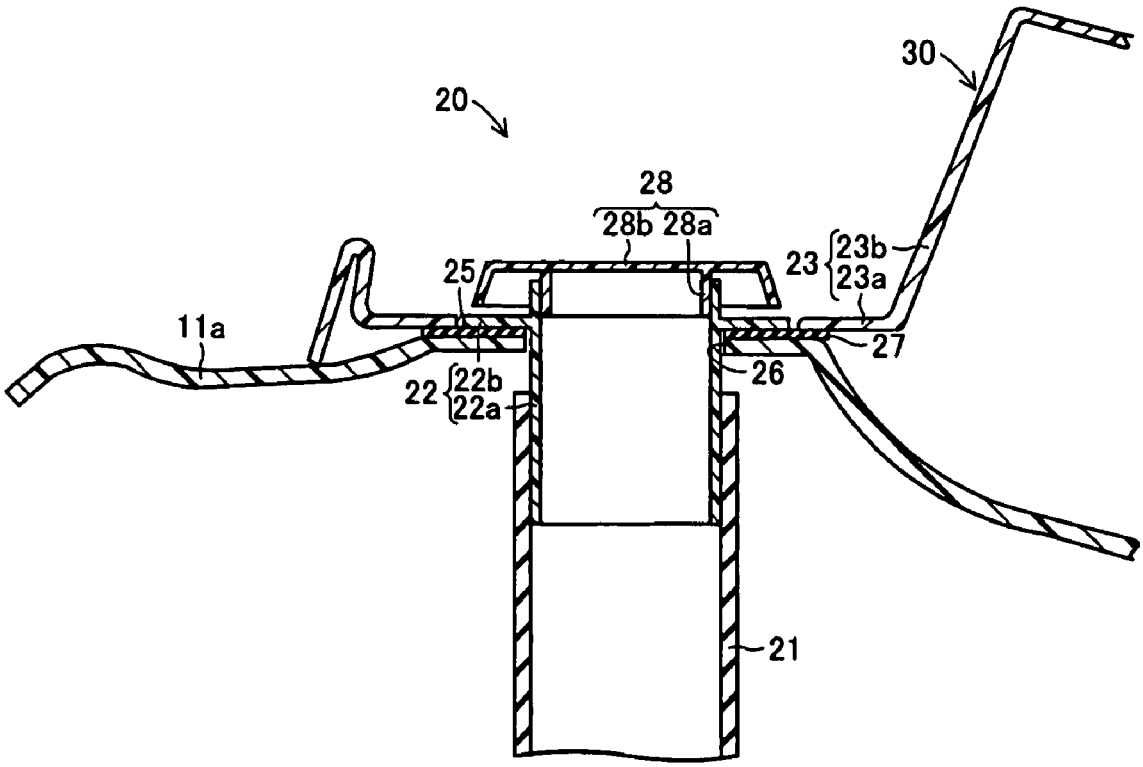
FIG. 6 shows a cross-sectional view of a portion of the small planing boat depicted in FIG. 1, illustrating a structure of a filler opening.
Figure 7:
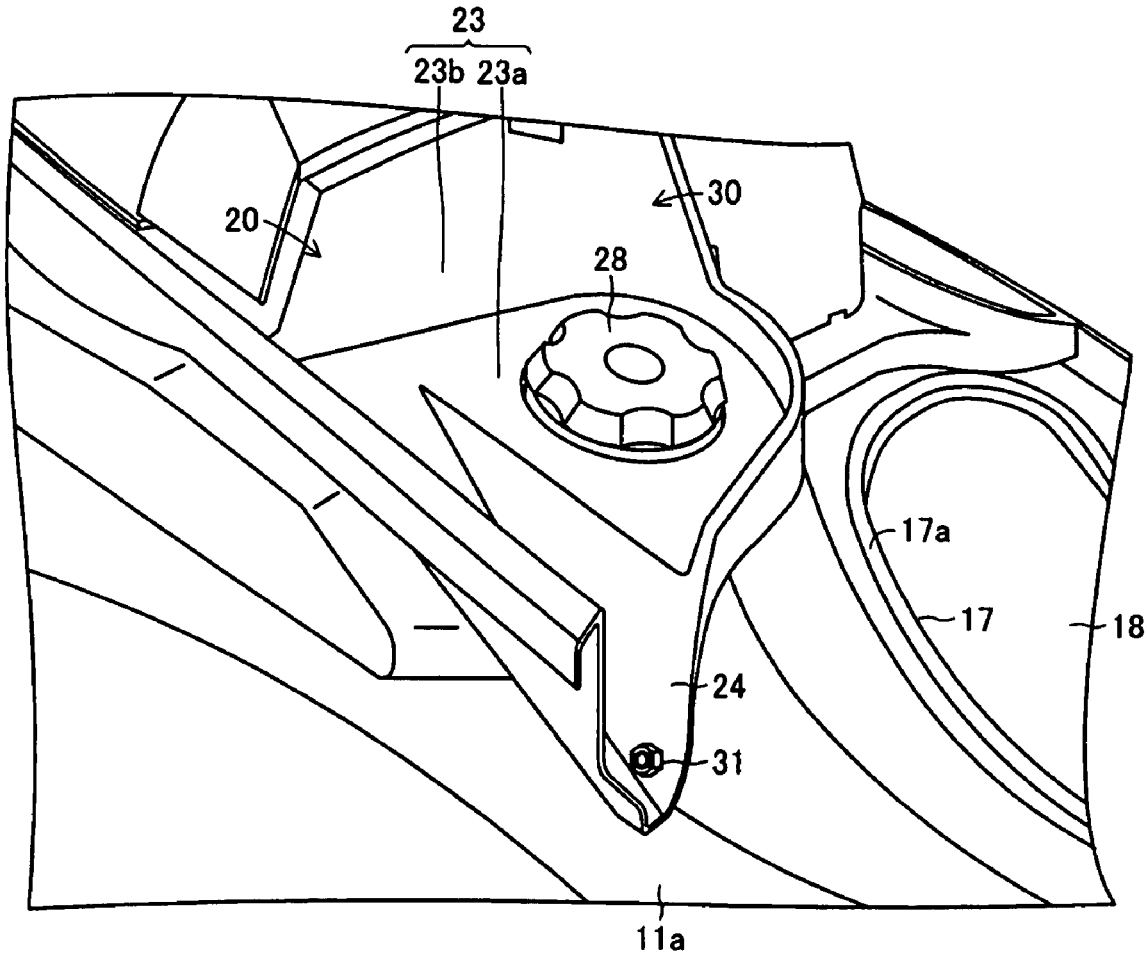
FIG. 7 shows an oblique view of a portion of the small planing boat depicted in FIG. 1, illustrating a fuel-receiving concave section and a guide groove.
Figure 8:
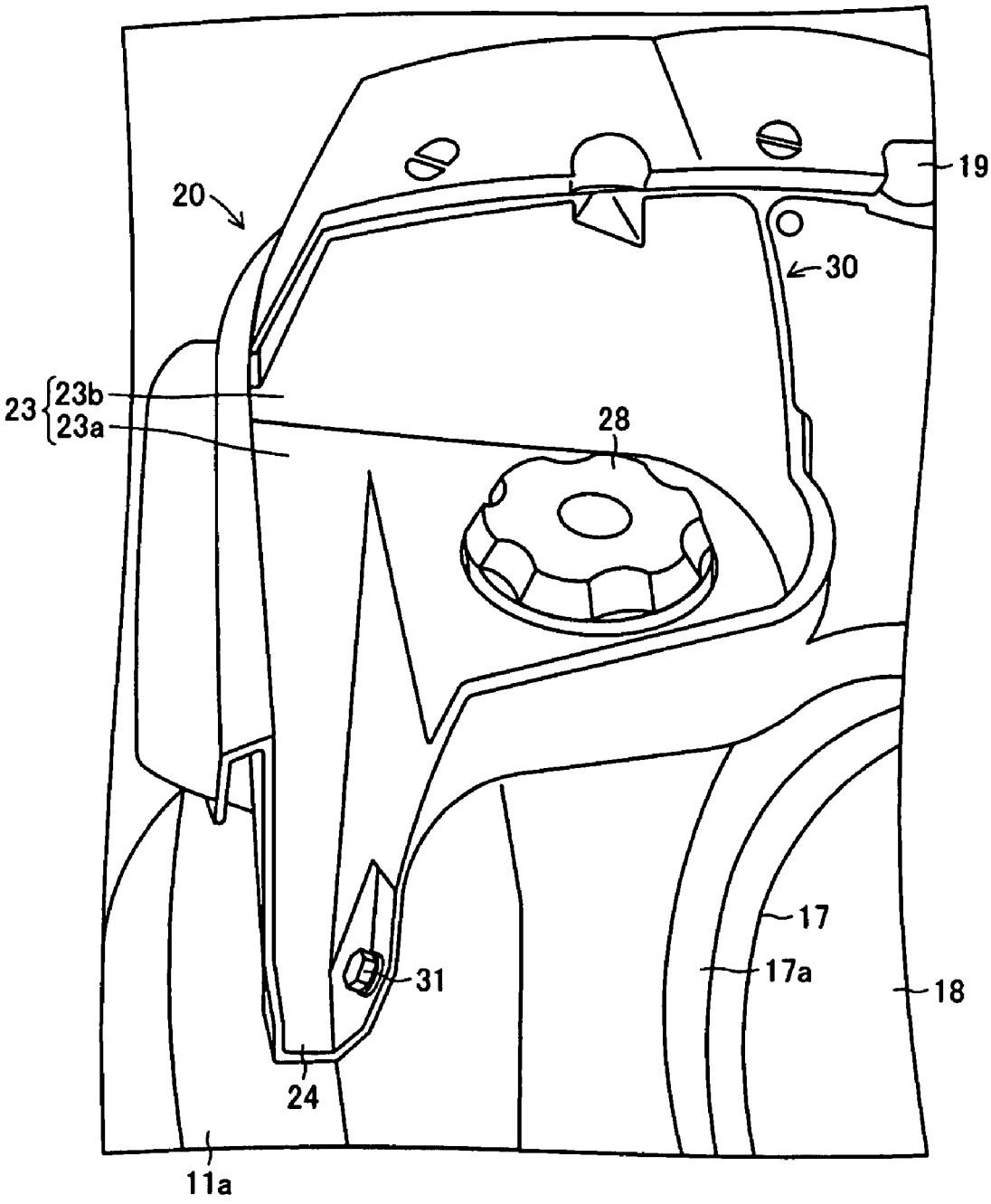
FIG. 8 shows another oblique view of the small planing boat depicted in FIG. 1, illustrating a fuel-receiving concave section and a guide groove.

In the vicinity of the opening section 17 on the upper surface of the deck 11*a*, a filling structure 20, shown in FIGS. 6-8, can be formed. In the illustrated embodiment, the filling structure 20 has a filler opening 22 that is in fluid communication with the fuel tank 14 via a hose 21. The filling structure 20 also has a fuel-receiving concave section 23 formed around the filler opening 22 and a guide channel or groove 24, extending from the fuel-receiving concave section 23 outward from the boat body 11. The fuel-receiving concave section 23 can, in some embodiments, be formed on the starboard side near a rear section of the opening section 17 on the upper surface of the deck 11*a*, and the filler opening 22 can be formed approximately at a center of the fuel-receiving concave section 23.

The fuel-receiving concave section 23 can be formed having a bottom surface section 23*a* that is a generally flat surface which declines slightly from a center side to an outer side (e.g., towards a starboard side of the boat body 11). The fuel-receiving concave section 23 also has a partition wall 23*b* formed to partially surround the bottom surface section 23*a*. The partition wall 23*b* can be formed such that a center side section of the partition wall 23*b* is higher than an outer side section. A guide groove 24 can be formed on a declining slope that declines in a frontward direction from a bottommost section (for example, an end on a starboard side) of the bottom surface section 23*a* to a front side of the boat body 11. In some embodiments, instead of having a generally flat shape, the bottom surface section 23*a* can have another advantageous shape that directs spilled fuel, or other fluid, towards the guide groove 24.

In some embodiments, the fuel-receiving concave section 23 and the guide groove 24 can be formed together as a concave section forming member 30, separately from a main body of the deck 11*a*, and can be made of resin. The concave section forming member 30 may be fixed on the deck 11*a* via one or more fixing members 31 as depicted in FIG. 7. In other embodiments, other fixing methods may be used. Furthermore, in some embodiments, the fuel-receiving concave section 23 and the guide groove 24 can be formed separately and can be fixed separately on the deck 11*a*.

In a generally central position of the bottom surface section 23*a* of the fuel-receiving concave section 23 of the concave section forming member 30, an insert hole 25 for insertion of the filler opening 22 can be formed. In a section of the deck 11*a* that corresponds to the insert hole 25, a fixing hole 26 having a diameter smaller than that of the insert hole 25 can be formed. The fixing hole 26 can be formed to install the filler opening 22 to the deck 11*a*, and the filler opening 22 can be installed to the deck 11*a* via the fixing hole 26. The filler opening 22 can be formed with a cylindrical filler opening main body 22*a* and a flange section 22*b* formed on an upper peripheral surface of the filler opening main body 22*a*. The filler opening can be installed by inserting the filler opening main body 22*a* in the fixing hole 26 and positioning the flange section 22*b* on an upper surface of the deck 11*a*.

The filler opening main body 22*a* can be connected with the hose 21 via a fixing member (not shown) made up of a band and a fastening section, or by using another well known fixing method. Between a bottom surface of the flange section 22*b* and an upper surface of the deck 11*a*, a seal member 27 can be attached.

A top end opening of the filler opening 22 can be closed with a cap 28. The cap 28 can be formed with a cylindrical section 28*a*, which can be shorter in an axial direction, and a holding section 28*b* surrounding an upper peripheral section of the cylindrical section 28*a*. Threaded sections (not shown), which can engage with each other, can be formed on a top inside surface of the filler opening 22 and on an outer peripheral surface of the cylindrical section 28*a* of the cap 28. The cap 28 can be removed for filling the fuel tank 14 with fuel via the filler opening 22. When not filling the fuel tank 14, the cap 28 can be closed to prevent fuel in the fuel tank 14 from being spilled out of the filler opening 22 and to prevent contaminants from entering the fuel tank 14.

The concave section forming member 30 can be installed on an upper surface of the deck 11*a* with its position fixed by the insert hole 25 by placing the flange section 22*b* of the filler opening 22 in the insert hole 25, and fixing the concave section forming member 30 on the deck 11*a* with one or more fixing member 31 and/or other fixing methods. A peripheral section of the insert hole 25 of the concave section forming member 30 presses an upper surface of the seal member 27, so that any liquid can be prevented from entering an upper surface or an inside of the deck 11*a* from the fuel-receiving concave section 23.

Figure 9:
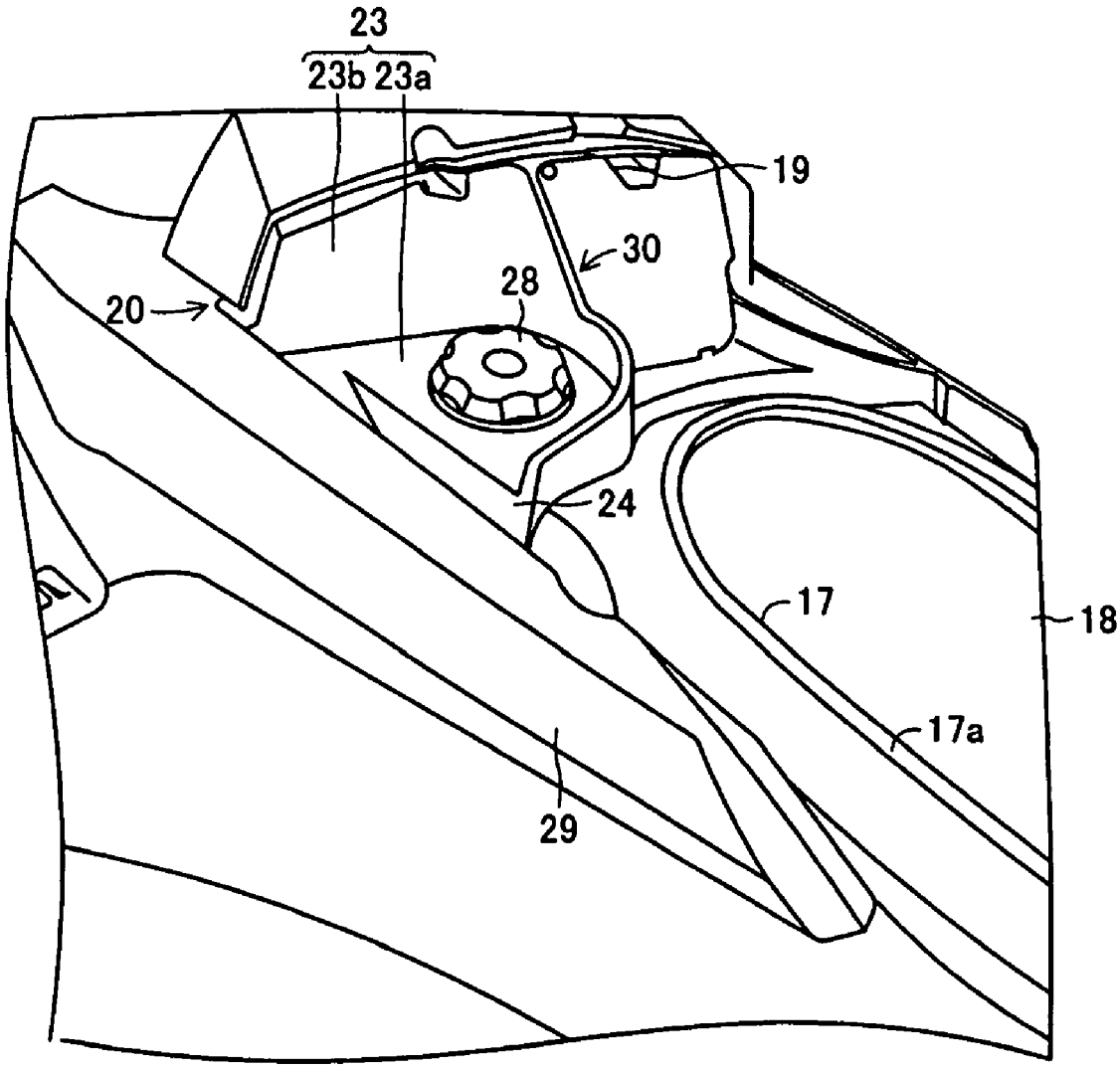
FIG. 9 shows an oblique view of the small planing boat depicted in FIG. 1, illustrating a state where a cover member can be attached to a deck.
Figure 10:
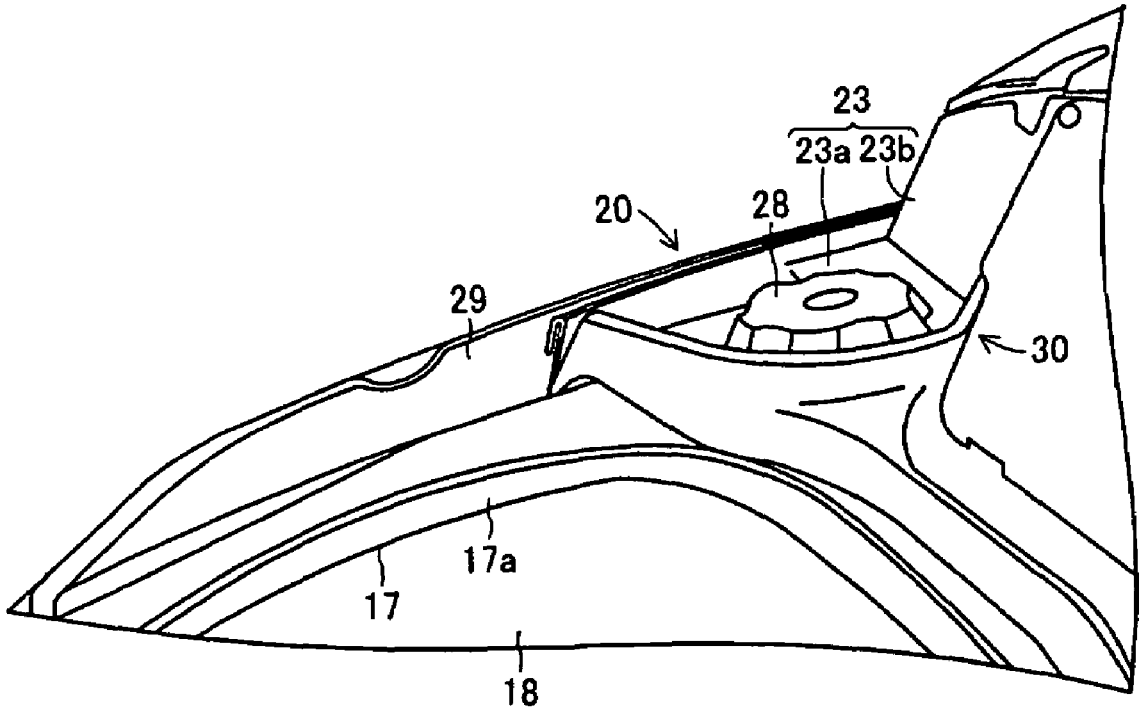
FIG. 10 shows an oblique view of a portion of the small planing boat depicted in FIG. 1, illustrating a state in which a cover member can be attached to a deck.

As shown in FIG. 9 and FIG. 10, a cover member 29 can be installed to an outer side of the fuel-receiving concave section 23 and the guide groove 24. A front section of the cover member 29 extends frontward beyond a front end of the guide groove 24, and there can be a narrow gap between a section positioned frontward beyond a front end of the guide groove 24 and the deck 11*a*. If fuel is spilled out into the fuel-receiving concave section 23 during filling, spilled fuel flows into the gap via the bottom surface section 23*a* of the fuel-receiving concave section 23 and the guide groove 24. The fuel drops in a downward direction at the side of the front section of the boat body 11 via the gap.

To navigate the small planing boat 10 illustrated in FIGS. 1-10 on the water, an operator can take a seat 13 and can turn on a start switch installed in the vicinity of the handlebars 12 in order to enable the small planing boat 10 to be in a navigable state. The operator operates the handlebars 12 and operates a throttle lever 12*b* installed to a grip 12*a* of the handlebars 12. By these operations, the operator navigates the small planing boat 10 in various directions and at various speeds corresponding to operations.

When it is desired to add fuel to the fuel tank 14, the small planing boat 10 can be stopped at a filling station or other appropriate location for filling. An engaging section of the hatch cover 16 relating to a lock mechanism can be unlocked.

A rear section of the hatch cover 16 can be lifted upward as shown in FIG. 2 and FIG. 3. The cap 28 can be rotated in a direction for releasing it and can be removed from the filler opening 22 to open the filler opening 22. A filling nozzle of a filling apparatus (not shown) can be inserted into the filler opening 22 and fuel can be added.

Because the filler opening 22 can be located in a high position in the rear section of the front section of the deck 11*a* that is elevated above the water level, a splash of water caused, for example, by a wave or passing boat cannot easily enter into the filler opening 22. If fuel coming out of the filling nozzle is spilled out of or overflows from the filler opening 22 during filling, the spilled fuel goes into the fuel-receiving concave section 23. Spilled fuel flows towards a side with the guide groove 24 following a slope on the bottom surface section 23*a* of the fuel-receiving concave section 23 and drops in a downward direction at a side of the front section of the boat body 11 via the guide groove 24.

As mentioned above, when the hatch cover 16 is closed, the opening section 17 can be covered. At the same time, the hatch cover 16 can also cover the cap 28 on the filler opening 22, the fuel-receiving concave section 23, and the guide groove 24. Therefore, the cap 28 and other components can be invisible from an outside, and the design of the small planing boat 10 can thus be enhanced. A top end of the filler opening 22 can be placed in the bottom surface section 23*a* of the fuel-receiving concave section 23 formed with the concave section forming member 30 on an upper surface of the deck 11*a*, and the guide groove 24 extending from the bottom surface section 23*a* of the fuel-receiving concave section 23 to a down direction on an outer side of the boat body 11.

Because fuel flows into the fuel-receiving concave section 23, even if fuel is spilled out of the filler opening 22 during filling, fuel does not spread around on an upper surface of the deck 11*a*. Because spilled fuel flows in a downward direction towards the front section of the boat body 11 via the guide groove 24, even if fuel spills out into the fuel-receiving concave section 23, the spilled fuel does not flow to a rear section of the deck 11*a* and stay on the floor and does not flow inside of the boat body 11 and into an inside of the opening section 17. The fuel-receiving concave section 23 can be formed with the bottom surface section 23*a* in a shape of a generally flat surface and the partition wall 23*b* surrounding the bottom surface section 23*a*, such that a portion of the bottom surface section 23*a* that is in communication with the guide groove 24 can be in a low position. Thus, fuel spilled out into the fuel-receiving concave section 23 does not stay there, but can be efficiently introduced in the guide groove 24 and therethrough to flow outside of the boat body 11.

Since the bottom surface section 23*a* can, in some embodiments, be formed to be flat, it can be easy to open and close the cap 28. Since the storage section 18 for storing an object can be formed in the opening section 17, the hatch cover 16 can be used as a lid for opening and closing the storage section 18 after storing a certain object therein 18. Since the seal section 17*a* can be formed between the opening section 17 and the hatch cover 16, water can be prevented from entering the storage section 18.

Since the filler opening 22 can be formed in a portion on a starboard side rearward from the opening section 17, the filler opening 22 can be in a higher position of the deck 11*a*. Therefore, water resulting from a splash or the like can more likely be prevented from entering the filler opening 22 during filling. In addition, because the guide groove 24 can be located on a side of the opening section 17 but on an outer side of the boat body, fuel spilled out of the filler opening 22 can be guided in a downward direction along an outside of the boat body 11, while a sufficient size of the opening section 17 can be ensured.

Since the fuel-receiving concave section 23 and the guide groove 24 can be formed in one piece as the concave section forming member 30, the number of parts can be reduced, and, in such embodiments, it is not necessary to assemble a member that includes the fuel-receiving concave section 23 and a member that includes the guide groove 24. Therefore, it becomes easy to form the fuel-receiving concave section 23 and the guide groove 24. Since it is not necessary to form the fuel-receiving concave section 23 or the guide groove 24 by processing the deck 11*a*, it becomes easy to make the deck 11*a* and to form the fuel-receiving concave section 23 and the guide groove 24. Since the concave section forming member 30 can be formed with resin, it may be easily and inexpensively manufactured and processed.

In the bottom surface section 23*a* of the fuel-receiving concave section 23, the insert hole 25 for insertion of the filler opening 22 can be formed. In a portion of the deck 11*a* that corresponds to the insert hole 25, the fixing hole 26 to which the filler opening main body 22*a* can be installed can be formed. Because the concave section forming member 30 may be installed to the deck 11*a* by placing the filler opening 22 in the insert hole 25, installation of the concave section forming member 30 can be very easy. Because the seal member 27 can be attached between a bottom surface of the flange section 22*b* of the filler opening 22 and the concave section forming member 30 and an upper surface of the deck 11*a*, it can be possible to prevent fuel from going from the fuel-receiving concave section 23 to an upper surface or an inside of the deck 11*a*.

The present invention is not limited to the embodiments mentioned above. The small planing boat according to the present invention can be implemented by changing it in an appropriate manner. For example, in the embodiment described above, the filler opening 22 is shown in a position on a rear side of the opening section 17 on the upper surface of the deck 11*a* on a starboard side, but it can be also possible to install the filler opening 22 on a port side. A section in the vicinity of the opening section 17 of the small planing boat 10 can be formed symmetrically, and a concave section for a fuel-receiving concave section can be formed in a section on a port side. Therefore, when the filler opening 22 can be formed on the port side, this concave section can be used.

It can be also possible that the filler opening 22 can be formed in a section on a front side or on a lateral side of the opening section 17 on the upper surface of the deck 11*a*. In the embodiment mentioned above, the concave section forming member 30 having the fuel-receiving concave section 23 and the guide groove 24 can be used. However, the fuel-receiving concave section 23 and the guide groove 24 can also be directly formed on the deck 11*a* instead of using the concave section forming member 30. In addition, each of a member including the fuel-receiving concave section 23 and a member including the guide groove 24 can be installed to the deck 11*a*. It can be desirable to install the guide groove 24 to a section outside a line parallel with the front-rear direction of the boat body 11 crossing a side end section of the opening section 17. In a case like this, if side sections on left and right sides of the opening section 17 can be inclined, it can be desirable to install the guide groove 24 to a section outside of a section positioned on an innermost side of a side section. In addition, an arrangement, a structure, and so forth of other sections forming the small planing boat according to the present invention can be also changed in an appropriate manner within a technical range of the present invention.

Although this invention has been disclosed in the context of certain preferred embodiments, it will be understood by those skilled in the art that the present invention extends beyond the specifically disclosed embodiments to other alternative embodiments and/or uses of the invention and obvious modifications and equivalents thereof. For example, although embodiments of the fluid filler opening system have been described herein as a system for guiding fuel to a fuel tank and for advantageously directing spilled fuel away from a small planing boat, it will be apparent to one of ordinary skill in the art that the fluid filler opening system may also be adapted and used in conjunction with other types of fluids that may be filled into receptacles on the boat. Furthermore, the systems and methods described herein, and their equivalents, may be advantageously used on other types of vehicles and, in particular, on other types of watercraft. The filler structure 20 may, in some embodiments, be positioned on a middle or rear portion of the watercraft, as may be desired based on the shape and structure of the craft.

Although the hatch cover 16 has been described as being configured to cover the opening section 17 and the fluid-receiving concave structure 23, in other embodiments of the present invention, the hatch cover 16 covers the fluid-receiving concave structure 23 and does not cover the opening section 17.

It is also contemplated that various combinations or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A small planing boat comprising a boat body that includes a fuel tank disposed within the boat body and a deck, the deck having an upper surface that forms a floor side of the deck with concave sections, the deck further having a front side section comprising: a hatch cover, an opening section configured to be closed and opened with the hatch cover, a filler opening provided in the vicinity of the opening section, the filler opening being in fluid communication with the fuel tank and adapted to be covered by closing the opening section with the hatch cover, a fuel-receiving concave section formed around the filler opening, the fuel-receiving concave section having a bottom surface section, the filler opening extending through the bottom surface section, and a guide groove formed to decline downward from the bottom surface section of the fuel-receiving concave section and to direct any spilled fuel in the fuel-receiving concave section to flow outwardly of the boat body and in a forward direction away from the concave sections of the floor side of the deck.

2. The small planing boat of claim 1, wherein a storage section is provided in the opening section on an inner side of the boat body.

3. The small planing boat of claim 1, wherein the fuel-receiving concave section is defined by the bottom surface section and by a partition wall, the partition wall being formed to at least partially surround the bottom surface section, and the bottom surface section having a generally flat shape that is disposed around the filler opening and that is formed to decline towards and be connected with the guide groove.

4. The small planing boat according to claim 3, wherein the guide groove extends from the fuel-receiving concave section toward a front side of the boat body.

5. The small planing boat according to claim 3, wherein the filler opening is disposed near a rear of the opening section and deviated to a side of a longitudinal center of the boat body, and the guide groove is formed so as to extend outside of the opening section.

6. The small planing boat of claim 5, wherein a storage section is provided in the opening section inside the boat body.

7. The small planing boat according to claim 5, wherein the concave section is formed of a concave member that is formed separately from the deck and wherein the concave member is further configured to include the guide groove.

8. The small planing boat according to claim 1, wherein the filler opening is disposed near a rear of the opening section and deviated to a side of a longitudinal center of the boat body, and the guide groove is formed so as to extend outside of the opening section.

9. The small planing boat according to claim 8, wherein the guide groove extends from the fuel-receiving concave section toward a front side of the boat body.

10. The small planing boat according to claim 8, wherein the concave section is formed of a concave member that is formed separately from the deck.

11. The small planing boat of claim 10, wherein the concave member is further configured to include the guide groove.

12. The small planing boat according to claim 11, wherein the concave section forming member is made from a resin member.

13. The small planing boat according to claim 11, wherein a hole having a diameter larger than a diameter of the filler opening is formed in a portion corresponding to a bottom section of the concave forming member, the filler opening extending through the hole when the concave forming member is installed to the deck, and a seal member is interposed between a peripheral edge of the hole and the deck.

14. The small planing boat according to claim 13, wherein the filler opening has a flange adapted to rest upon the seal.

15. The small planing boat according to claim 13, wherein the guide groove extends from the fuel-receiving concave section toward a front side of the boat body.

16. The small planing boat according to claim 1, wherein the guide groove extends from the fuel-receiving concave section toward a front side of the boat body.

17. The small planing boat according to claim 1, further comprising a steering device, wherein the fuel-receiving concave section and the guide groove are positioned forward of the steering device.

18. The small planing boat according to claim 17, wherein the fuel-receiving concave section and the guide groove are positioned sufficiently forward of the steering device to prevent spilled fuel from flowing rearwards onto the concave sections of the floor side of the deck.

19. The small planing boat according to claim 17, wherein the steering device is a set of handlebars.

20. The small planing boat according to claim 1, wherein the fuel-receiving concave section and the guide groove are positioned forward of the concave sections of the floor side of the deck.

21. The small planing boat according to claim 1, wherein the fuel-receiving concave section further comprises a partition wall with at least a rear portion and a forward portion, the rear portion extending higher than the forward portion.

22. The small planing boat according to claim 21, wherein the rear portion of the partition wall is configured to prevent spilled fuel from flowing rearwards onto the concave sections of the floor side of the deck.

* * * * *